United States Patent [19]

Negahdari

[11] Patent Number: 4,785,838

[45] Date of Patent: Nov. 22, 1988

[54] MULTIPURPOSE INFANT SHADE

[76] Inventor: Viki R. Negahdari, 1064 Almarida San Jose, Calif.

[21] Appl. No.: 465,005

[22] Filed: Feb. 8, 1983

[51] Int. Cl.[4] ..... E04H 15/58

[52] U.S. Cl. ..... 135/117; 297/184; 135/104; 135/119

[58] Field of Search ..... 135/88, 89, 90, 95, 135/96, 100, 101, 102, 103, 104, 106, 109, 115, 119, 117, 120, 900, 902; 280/47.38, 47.39; 297/184

[56] References Cited

U.S. PATENT DOCUMENTS

| | | | |
|---|---|---|---|
| 2,812,769 | 11/1957 | Schaefer et al. | 135/102 X |
| 3,534,750 | 10/1970 | Kolozsvary | 135/117 X |
| 3,837,117 | 3/1975 | Perego | 280/47.38 X |

*Primary Examiner*—Robert A. Hafer
*Assistant Examiner*—Danton D. DeMille
*Attorney, Agent, or Firm*—Michael J. Hughes

[57] ABSTRACT

The present invention is a multipurpose infant shade adapted for attachment to a variety of infant furniture items. The shade includes a flexible, semi-rigid support arch member, symetrical left and right panel members, a top panel member and attachment elements for securing the shade to the furniture item. The various panel members are opaque to prevent bright light and other common radiation from reaching the infant. The shade is lightweight, portable and flexible so that it may be readily adapted to and exchanged among a variety of furniture items such as infant car seats, car beds, swings and strollers. For aesthetic purposes the panel materials may be selected to have attractive colors and patterns and the shade may be provided with a decorative ruffle.

7 Claims, 1 Drawing Sheet

MULTIPURPOSE INFANT SHADE

The present invention relates generally to furniture and effects and more particularly to furniture and accessories specifically designed for use by infants. The predominant current usage of the multipurpose infant shade is in connection with infant car seats, swings, car beds and perambulators.

BACKGROUND ART

Infant care has been a primary concern of human kind since the dawn of time. Large amounts of capital and time are expended in the pursuit of keeping babies healthy and happy. Improved devices are constantly being introduced.

Infants are particularly sensitive to harm from electromagnetic radiation. A baby's skin and eyes are much more sensitive than those of adults. Infants are easily sunburned and can suffer eye damage from direct sunlight. It is therefore important to protect the baby from over-exposure. This is particularly important in situations where the baby is somewhat free to throw-off blankets, bonnets and other protections wrapped about the infant. Such situations occur in infant car seats and other items of infant transport and furniture.

One of the difficulties with infant car seats and other methods of carrying and securing infants is that they provide little or no protection from the sun. Since the infant is ordinarily secured in a reclining position, the rays of the sun which come in through the car's windows or sunroof will often fall directly upon the face of the baby. It is orginarily not practical to place a permanent shade device on an infant car seat because it limits the accessibility of the infant. Furthermore, any sort of rigid type of shade could significantly increase the risk of harm to the infant in the case of an accident.

The problem with unrestricted sunshine on the skin of an infant is not limited to the car seat situation. Traditional baby perambulators or strollers have included cowls which provide a shaded area of the stroller for the baby's head. These cowls have traditionally been an integral part of the stroller device. Other types of infant furniture have also occasionally been provided with some variety of sunshade device. Makeshift half-tents and other relatively portable devices have also been utilized for protecting infants and other items from the sun in outdoor settings such as parks or beaches.

A need has arisen for an appropriate all-purpose baby shade device which may be utilized in a variety of applications. Such a device, in order to be desirable, must combine the features of effectiveness, portability and safety. Prior art devices have been, in the main, nonportable in that they have been rigidly attached to a specific item. The prior art devices which have been portable tend to be rigid, a factor which severely limits the safety since the collapse or movement of such a device could harm the infant. The exposed support posts of various prior art devices have created a significant problem due to the infants' penchant for grasping and pulling anything within reach. The effectiveness of such devices is thus vitiated since they are often collapsed by the infant, a factor which can also be a safety hazard since the infant might then asphixiate in the shade material. None of the prior art devices have adequately fulfilled the need for a multipurpose infant shade which is economical, readily portable, effective and safe.

DISCLOSURE OF INVENTION

Accordingly, it is an object of the present invention to provide a multipurpose infant shade which may be readily adapted for use with a variety of infant carriers and furniture, and also as a stand alone item.

It is another object of the present invention to provide an infant shade device which contains no rigid elements which might harm the baby.

It is a further object of the present invention to provide an infant shade device which is economical to manufacture and is compact for storage purposes.

It is yet another object of the present invention to provide an easily cleaned infant shade.

This invention is a portable and readily attachable and detachable infant shade for providing protection of a baby from sunlight and other bright light. The present invention is particularly adapted for attachment to infant car seats, car beds, swings and strollers.

Briefly, a preferred embodiment of the present invention is a multipurpose infant shade device. The infant shade includes a flexible, semi-rigid support arch member for holding the shade in the proper shape and orientation, symetrical opaque left and right side panels and an opaque top panel for providing protection from electromagnetic radiation. The shade further includes attachment elements by which the shade may be readily attached to and detached from rigid furniture items. The preferred attachment elements are VELCRO patches at appropriate positions on the shade meeting with corresponding patches mounted on the item. The shade may also be provided with easily cleaned lining materials and decorative ruffles.

An advantage of the present invention is that the rapid attachment and detachment elements allow the infant shade to be usd with a variety of infant furniture items and to be quickly transferred to whatever item the baby is presently utilizing.

Another advantage of the present invention is that the infant shade is a resiliant construction which returns to the desired shape after deformation.

A further advantage of the present invention is that the infant shade may be compressed into a relatively planar form with no need for any disassembly for storage and transport.

Yet another advantage of the present invention is that it contains no rigid or sharp elements which may harm a baby.

Still another advantage of the present invention is that the entire shade is washable without disassembly.

These and other objects and advantages of the present invention will become clear to those skilled in the art in view of the description of the best presently known mode of carrying out the invention and the industrial applicability of the preferred embodiment as described herein and as illustrated in the several figures of the drawing.

BEST MODE FOR CARRYING OUT INVENTION

The best presently known mode of practicing the present invention is a multipurpose infant shade device for use as a stand-alone item or as a readily attachable and detachable item for use with baby furniture and transport equipment. The multipurpose infant shade is a resiliant semi-rigid construction which may be readily deformed to fit on a variety of different shapes while retaining its shade characteristics.

Figure 1:
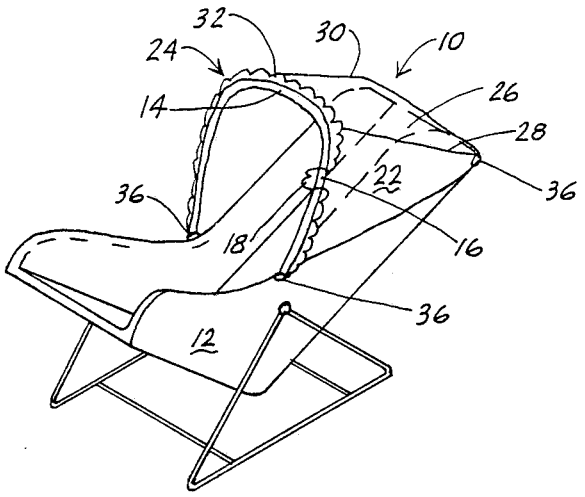
FIG. 1 is a perspective view of a multipurpose infant shade according to the present invention shown as installed upon a typical infant car seat.

The multipurpose infant shade is illustrated in a perspective view in FIG. 1 and is designated by the general reference character 10. In FIG. 1 the infant shade 10 is shown as instatlled upon a typical infant car seat 12.

The main support member of the infant shade 10 is a support arch 14. In FIG. 1 a portion of the interior of the support arch 14 is exposed to illustrate a elongated structural foam member 16 enclosed within a tube 18. The tube 18 is simply formed longitudinally by wrapping a planar fabric member about the cylindrical structural foam 16 and fastening the fabric. The fastening is accomplished by a tube seam 20 which extends along one side of the tubular support arch 14. The structural foam 16 is selected such that the support arch 14 is strong enough to hold the infant shade 10 in its desired shape during use. The structural foam 16 is also selected to be flexible and soft such that the shade 10 may be folded for storage. The flexibility is also desirable so that there is no danger of an infant coming to harm by impacting any portion of the shade 10.

The preferred embodiment of the infant shade 10 further includes a left side panel 22, a right side panel 24 and a top or back panel 26. The left side panel 22 and right side panel 24 are triangular in shape and are symetrical to each other. The top panel 26 is trapezoidal in shape. Each of the panels, 22, 24, and 26 is attached to the support arch 14 at the tube seam 20. The panels 22, 24 and 26 are opaque or at least translucent with respect to visible and ultraviolet radiation in order to properly shade the baby. The left side panel 22 is joined to the top panel 26 by a top left seam 28 while the right side panel 24 is joined to the top panel 26 by a top right seam 30. The side and top panel are constructed of soft but lightly structural materials, such as quilted fabric. This construction causes the panels to generally retain their shape when supported by the support arch 14 but also allows great flexibility.

The preferred embodiment of the infant shade 10 is provided with a decorative ruffle 32 attached near the tube seam 20. The interior of the shade 10 is also provided with a lining 34 along the interior faces of the left side panel 22, the right side panel 24 and the top panel 26. The lining 34 is selected to aid in supporting the shape of the panels and also is selected to be an easily cleaned material.

The multipurpose infant shade 10 is attached to the car seat 12 or other item by a plurality of fasteners 36 situated at appropriate points. In the preferred embodiment, the fasteners 36 are situated at the bottom interior of either side and at the farthest back portions of the interior of the top left seam 28 and the top right seam 30 of the support arch 14. In the preferred embodiment, the fasteners 36 are selected to be one of the components of the well known two-component fastener material VELCRO. The small swatch of either of the VELCRO components is firmly attached to the article to which the shade 10 is to be attached, in this case, the car seat 12. Each swatch is placed at a suitable location for attachment of the shade-10. The mating component of the VELCRO forms the fasteners 36 which are attached to the shade 10. The male and female VELCRO swatches thus provide an easy means for attaching the shade 10 to the article at the location of the fasteners 36.

Figure 2:
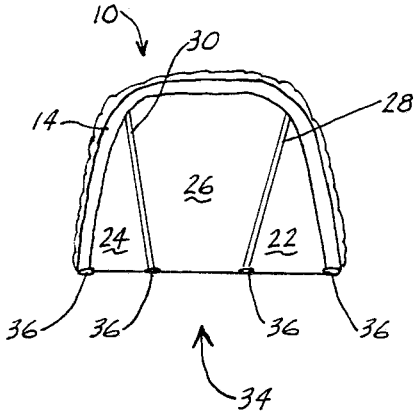
FIG. 2 is a front view of the infant baby shade of FIG. 1, shown standing alone on a planar surface.

FIG. 2 illustrates the multi-purpose infant shade 10 of the present invention shown as standing alone upon a flat surface. This figure illustrates the interior elements of the shade 10. It maybe seen that the support arch 14 forms a roughly semi-circular arch and provides an opening into the interior of the shade 10. The interior of the left side panel 22, the right side panel 24 and the top panel 26 are shown, along with the interior portions of the top left seam 28 and the top right seam 30. It may be seen that the shade 10 narrows from front to back in a hemiconical manner. The entire interior of the shade 10 in the preferred embodiment is covered by the lining 34. This figure also illustrates the preferred location of the fasteners 36.

Figure 3:
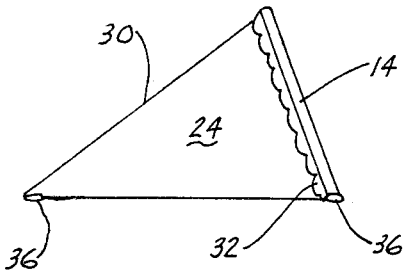
FIG. 3 is a right side elevational view of the infant shade of FIG. 2.

FIG. 3 illustrates the multipurpose infant shade 10 from the right side elevational view. This figure illustrates the shaping of the shade 10 when set upon a flat surface. In this view it may be seen that the support be provided by the side panels 22 and 24. One method of accomplishing this support without requiring undue rigidity in the side panels themselves is to fortify the top left seam 28 and the top right seam 30. In one alternate embodiment, this fortification is accomplished by incorporating a smaller tube of structural foam along each of the seams. However, utilizing a relatively stiff quilted fabric for the panels, heavy stitching and a starched liner 34 is sufficient to provide support rigidity in most cases.

Another method of providing structural support to the shade 10 is to incorporate a layer of foam sheet between the panels and the liner 34. A foam sheet of approximately 0.47 cm (3/16"), quilted to the panels and liner, has been found to be sufficiently stiff to cause the shade 10 to maintain its shape during ordinary use.

FIG. 3 also illustrates that the support arch 14 does not extend all of the way to the bottom of the shade 10. This is necessary such that the fasteners 36 which are attached at the very bottom of the support arch may be on flexible material so that they may be easily manipulating and attached to various mating elements.

The preferred embodiment of the multipurpose infant shade 10 is constructed entirely out of washable materials. It is the nature of infants that they soil anything with which they come in contact. Therefore, the shade 10 is constructed such that it may be thoroughly washed, and even washed in a washing machine, without destroying its value. For this reason, care must be taken in selection of the structural foam 16 such that it is not degraded by contact with water and detergents and also that it dries effectively.

An alternate structural member to the foam 16 is an inflated bladder such as a tubular balloon encased within the tube 18. Such a balloon functions in the same manner as the foam 16 and may be more easily handled and cheaper. However, the danger of puncture and deflation, debilitating the usefulness of the shade 10, is enough of a disadvantage to make foam the preferred structural material.

The material utilized for the tube 18 and the various panels 22, 24 and 26 is typically a woven cotton having a desirable appearance. This may be a print or a gingham. Various polyesters and combination materials are also appropriate. The material in the preferred embodiment is quilted to provide additional structural support. The lining material is selected to be a reasonably stiff but gentle to the touch material such as "style-a-shade" or "shape-a-shade." If the quilted foam lining is utilized, then the actual lining material is a matter of choice.

The fasteners of the preferred embodiment are selected to have the female VELCRO swatches attached to the shade 10 while the male VELCRO swatches ae installed on the items to which the shade is to be attached. This selection is made because the shade 10 is occasionally utilized as a stand alone item such as in a park, and the infant may have access to the fasteners. The female VELCRO is slightly less abrasive than the male.

The dimensions of the preferred embodiment are as follows. The circumference of the support arch 14 is selected to be approximately 1.05 meters (40.5"), the top left seam 28 and the top right seam 30 are selected to have a length of approximately 0.35 meters (14.5"). This separation of the left top seam 28 and the right top seam 30 at the tube seam 20 is approximately 0.28 meters (11") and the separation at the back is approximately 0.15 meters (6"). When the shade 10 is standing alone, the highest point on the support arch 14 has a height of approximately 0.3 meters (12"), while the arch has a base of approximately 0.5 meters (18"). The dimensions are selected specifically to conform for ready attachment to the majority of infant furniture items. In addition, the flexibility of the shade 10 allows for ready deformation if it is desired to attach the shade to furniture or transport items which do not conform to the exact dimensions selected. The precise dimensions and materials utilized in the invention are largely a matter of choice. As long as they conform to the basic requirements, the individual user may select whatever orientation and arrays as may be desirable.

Those skilled in the art will readily observe that numerous other modifications and alterations of the multipurpose infant shade may be made while retaining the teachings of the invention. Accordingly, the above disclosure is not intended as limiting. The appended claims are therefore to be interpreted as encompassing the entier spirit and scope of the invention.

INDUSTRIAL APPLICABILITY

The multipurpose infant shade of the present invention is particularly adapted to use with various items of infant furniture. It is especially intended for use with car beds, car seats, baby strollers and perambulators baby swings, highchairs and other items of infant furniture. The multipurpose infant shade may be attached to any of these items to protect the infant's skin and eyes from sunlight and other bright electromagnetic radiation.

In order to adapt the multipurpose infant shade to maximum use, the user attaches the mating component of the fasteners, in the preferred embodiment, male VELCRO, to the furniture or transport item in the appropriate locations. The multipurpose infant shade may then be readily attached or detached from any of the items by the simple expedient of mating the two components of the fasteners with each other. A single infant shade may then be used with the entire variety of infant furniture items. The shade may simply be moved with the infant.

The multipurpose infant shade is also capable of use as a stand alone item. If the baby is to be placed outdoors such as on grass or on a blanket, the infant shade will be self supporting and will provide a method of shading the head.

Since the multipurpose infant shade of the present invention is simple and economical to manufacture, and because it is adaptable to the wide range of different uses it is expected that there will be a significant degree of applicability for the invention. This applicability is enhanced when the factors such as the compact storage and easy cleaning of the multipurpose infant shade are considered.

I claim:

1. A multipurpose infant shade comprising:

a flexible support arch member including an elongated cylindrically formed structural foam encased within a tube;

a left side panel, a right side panel and a top panel, each said panel comprising material which is at least semi-opaque to electromagnetic radiation and attached to the same side of the support arch so as to form therewith a hollow hemiconical shade; and attachment means situated at various positions on the periphery of said hollow shade for attaching said hollow shade to selected articles.

2. A multipurpose infant shade comprising:

a flexible support arch member including a tubular inflatable bladdere, inflated to provide structural support to the arch member;

a left side panel, a right side panel and a top panel, each said panel comprising material which is at least semi-opaque to electromagnetic radiation and attached to the same side of the support arch so as to form therewith a hollow hemiconical shade; and attachment means situated at various positions on the periphery of said hollow shade for attaching said hollow shade to selected articles.

3. A multipurpose infant shade comprising:

a flexible support arch member;

a left side panel, a right side panel and a top panel, each said panel comprising material which is at least semi-opaque to electromagnetic radiation and attached to the same side of the support arch so as to form therewith a hollow hemiconical shade; and attachment means including a plurality of first fastener components in the form of female VELCRO attached at various positions on the periphery of said hollow shade and an equal plurality of second fastener components in the form of male VELCRO, adapted to mate with said first fastener components, attached to matching positions on an article upon which the shade is to be mounted.

4. A multipurpose infant shade device, in the shape of a hollow half frustum of a reclining cone, comprising:

a support arch member including an elongated cylindrical foam member longitudinally enclosed within a fabric tube;

a fabric left side panel, in the form of a triangle, attached along one side of said triangle to said fabric tube;

a fabric top panel, in the form of a trapezoid, attached along the base of said trapezoid to said fabric tube and along one side of said trapezoid to the left side panel;

a fabric right side panel, triangular in shape and symmetrical with the left side panel, attached along one side of said triangle to said fabric tube and along a second side of said triangle to the free side of said trapezoid; and a plurality of fastener means situated on the interior of the device for attaching the device to a selected article of infant funiture or transport.

5. The device of claim 4 and further including:

a liner attached to the interior surface of the left side panel, the top panel and the right side panel.

6. The device of claim 4 and further including:

a plurality of separate mating means attached to said selected article and adapted to mate upon contact with the fastener means to form a union, such union being readily disassociated when desired.

7. The device of claim 4 wherein:

said fabric is quilted to provide structural integrity.

* * * * *